US010892121B2

(12) United States Patent
You et al.

(10) Patent No.: US 10,892,121 B2
(45) Date of Patent: Jan. 12, 2021

(54) LIGHT-EMITTING KEYSWITCH, CAP STRUCTURE AND CAP STRUCTURE MANUFACTURING METHOD THEREOF

(71) Applicant: DARFON ELECTRONICS CORP., Taoyuan (TW)

(72) Inventors: Wei-Yan You, Taoyuan (TW); Tsai-Jung Hu, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/795,608

(22) Filed: Feb. 20, 2020

(65) Prior Publication Data

US 2020/0294739 A1 Sep. 17, 2020

(30) Foreign Application Priority Data

Mar. 15, 2019 (TW) ..... 108108749 A

(51) Int. Cl.
*H01H 13/83* (2006.01)
*H01H 13/7065* (2006.01)

(52) U.S. Cl.
CPC ..... *H01H 13/83* (2013.01); *H01H 13/7065* (2013.01); *H01H 2219/04* (2013.01); *H01H 2219/046* (2013.01); *H01H 2219/048* (2013.01)

(58) Field of Classification Search
CPC ..... H01H 13/83; H01H 13/7065; H01H 2219/048; H01H 2219/046; H01H 2219/04; H01H 13/14; H01H 3/125; H01H 13/705; H01H 13/70; H01H 13/7006; H01H 13/703; H01H 19/20; H01H 2219/062;

(Continued)

(56) References Cited

U.S. PATENT DOCUMENTS

2004/0129542 A1* 7/2004 Kawaguchi ..... H01H 9/182 200/61.1
2006/0254894 A1* 11/2006 Jung ..... H01H 13/83 200/314

(Continued)

FOREIGN PATENT DOCUMENTS

CN 101194329 A 6/2008
CN 102683074 A 9/2012

(Continued)

*Primary Examiner* — Ahmed M Saeed
(74) *Attorney, Agent, or Firm* — Winston Hsu

(57) ABSTRACT

A light-emitting keyswitch includes a board, a lifting mechanism and a cap structure. The cap structure is assembled with the lifting mechanism to be movable upward and downward relative to the board and includes a cap and a light-emitting layer. The light-emitting layer includes first and second pad layers disposed on a lateral contour surface of the cap and spaced from each other, a lower electrode layer, a dielectric layer, an electroluminescent layer, an upper electrode layer and a transparent pattern layer stacked on a top surface of the cap, and an external trace structure. The lower and upper electrode layers are connected to the first and second pad layers respectively. The external trace structure is connected to the first and second pad layers for transmitting power to the upper and lower electrode layers, so as to drive the electroluminescent layer to emit light to the transparent pattern layer.

18 Claims, 6 Drawing Sheets

(58) Field of Classification Search
CPC ..... H01H 13/023; H01H 2219/036; H01H 9/182; H01H 19/025
See application file for complete search history.

(56) References Cited

U.S. PATENT DOCUMENTS

| | | | | |
|---|---|---|---|---|
| 2008/0100580 | A1* | 5/2008 | Han | H01H 13/702 345/168 |
| 2008/0179173 | A1* | 7/2008 | Jung | H01H 13/83 200/314 |
| 2009/0050456 | A1* | 2/2009 | Kim | G02B 6/006 200/314 |
| 2009/0183976 | A1* | 7/2009 | Chang | H01H 13/70 200/345 |
| 2017/0076884 | A1 | 3/2017 | Chao | |
| 2018/0012714 | A1 | 1/2018 | Chen | |

FOREIGN PATENT DOCUMENTS

| | | |
|---|---|---|
| CN | 108470655 A | 8/2018 |
| TW | 476441 | 2/2002 |
| TW | M388085 U1 | 9/2010 |

* cited by examiner

LIGHT-EMITTING KEYSWITCH, CAP STRUCTURE AND CAP STRUCTURE MANUFACTURING METHOD THEREOF

BACKGROUND OF THE INVENTION

1. Field of the Invention

The present invention relates to a light-emitting keyswitch, a cap structure and a cap structure manufacturing method thereof, and more specifically, to a light-emitting keyswitch of directly forming a light-emitting layer on a cap, a cap structure and a cap structure manufacturing method thereof.

2. Description of the Prior Art

A keyboard, which is the most common input device, can be found in variety of electronic apparatuses for users to input characters, symbols, numerals and so on by pressing keyswitches on the keyboard. Furthermore, consumer electronic products and industrial machine tools are all equipped with a keyboard for performing input operations.

In practical application, the prior art usually adopts the design that a light emitting diode is disposed under a cap of the keyswitch to emit light to the cap for generating the cap illumination effect, so that the keyswitch can provide a light emitting function. However, in the aforesaid design, the related optical structural design and circuit configuration of the light emitting diode may occupy much internal space of the keyswitch, so as to be disadvantageous to the thinning design of the keyswitch.

SUMMARY OF THE INVENTION

The present invention provides a light-emitting keyswitch including a board, a lifting mechanism, and a cap structure. The lifting mechanism is disposed on the board. The cap structure is assembled with the lifting mechanism to be movable upward and downward relative to the board. The cap structure includes a cap and a light emitting layer. The cap has a top surface and a lateral contour surface. The light-emitting layer includes a first pad layer, at least one lower electrode layer, a second pad layer, a dielectric layer, an electroluminescent layer, an upper electrode layer, a transparent pattern layer, and an external trace structure. The first pad layer is disposed on the lateral contour surface. The at least one lower electrode layer is disposed on the top surface to be connected to the first pad layer. The at least one lower electrode layer has an opening. The second pad layer is disposed on the lateral contour surface corresponding to the opening and spaced apart from the at least one lower electrode layer. The dielectric layer is stacked on the lower electrode layer. The electroluminescent layer is stacked on the dielectric layer. The upper electrode layer is stacked on the electroluminescent layer and connected to the second pad layer. The transparent pattern layer is stacked on the upper electrode layer. The external trace structure is connected to the first pad layer and the second pad layer for transmitting a power to the upper electrode layer and the lower electrode layer via the first pad layer and the second pad layer, so as to drive the electroluminescent layer to emit light to the transparent pattern layer.

The present invention provides a cap structure assembled with a lifting mechanism to be movable upward and downward relative to a board. The cap structure includes a cap and a light-emitting layer. The cap has a top surface and a lateral contour surface. The light-emitting layer includes a first pad layer, at least one lower electrode layer, a second pad layer, a dielectric layer, an electroluminescent layer, an upper electrode layer, a transparent pattern layer, and an external trace structure. The first pad layer is disposed on the lateral contour surface. The at least one lower electrode layer is disposed on the top surface to be connected to the first pad layer. The at least one lower electrode layer has an opening. The second pad layer is disposed on the lateral contour surface corresponding to the opening and spaced apart from the at least one lower electrode layer. The dielectric layer is stacked on the lower electrode layer. The electroluminescent layer is stacked on the dielectric layer. The upper electrode layer is stacked on the electroluminescent layer and connected to the second pad layer. The transparent pattern layer is stacked on the upper electrode layer. The external trace structure is connected to the first pad layer and the second pad layer for transmitting a power to the upper electrode layer and the lower electrode layer via the first pad layer and the second pad layer, so as to drive the electroluminescent layer to emit light to the transparent pattern layer.

The present invention further provides a cap structure manufacturing method. The cap structure manufacturing method includes providing a cap having a top surface and a lateral contour surface, disposing a first pad layer on the lateral contour surface, and disposing at least one lower electrode layer on the top surface. The at least one lower electrode layer is connected to the first pad layer and has an opening. The cap structure manufacturing method further includes disposing a second pad layer on the lateral contour surface corresponding to the opening and stacking the at least one lower electrode layer, a dielectric layer, an electroluminescent layer, an upper electrode layer and a transparent pattern layer. The second pad layer is spaced apart from the at least one lower electrode layer, and the upper electrode layer is connected to the second pad layer. The cap structure manufacturing method further includes connecting an external trace structure to the first pad layer and the second pad layer. The external trace structure transmits a power to the upper electrode layer and the lower electrode layer via the first pad layer and the second pad layer for driving the electroluminescent layer to emit light to the transparent pattern layer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
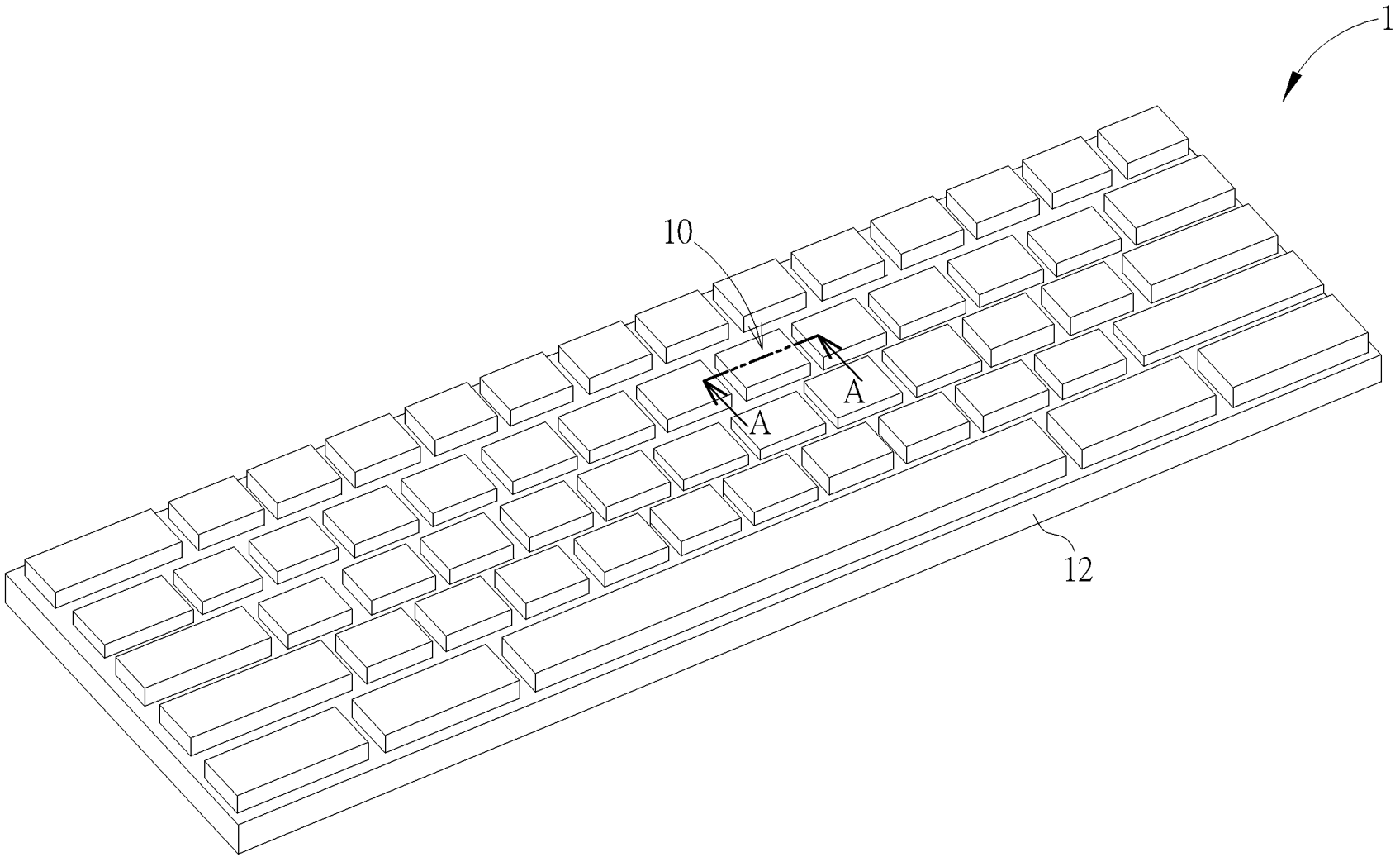
FIG. 1 is a diagram of a keyboard according to an embodiment of the present invention.
Figure 2:
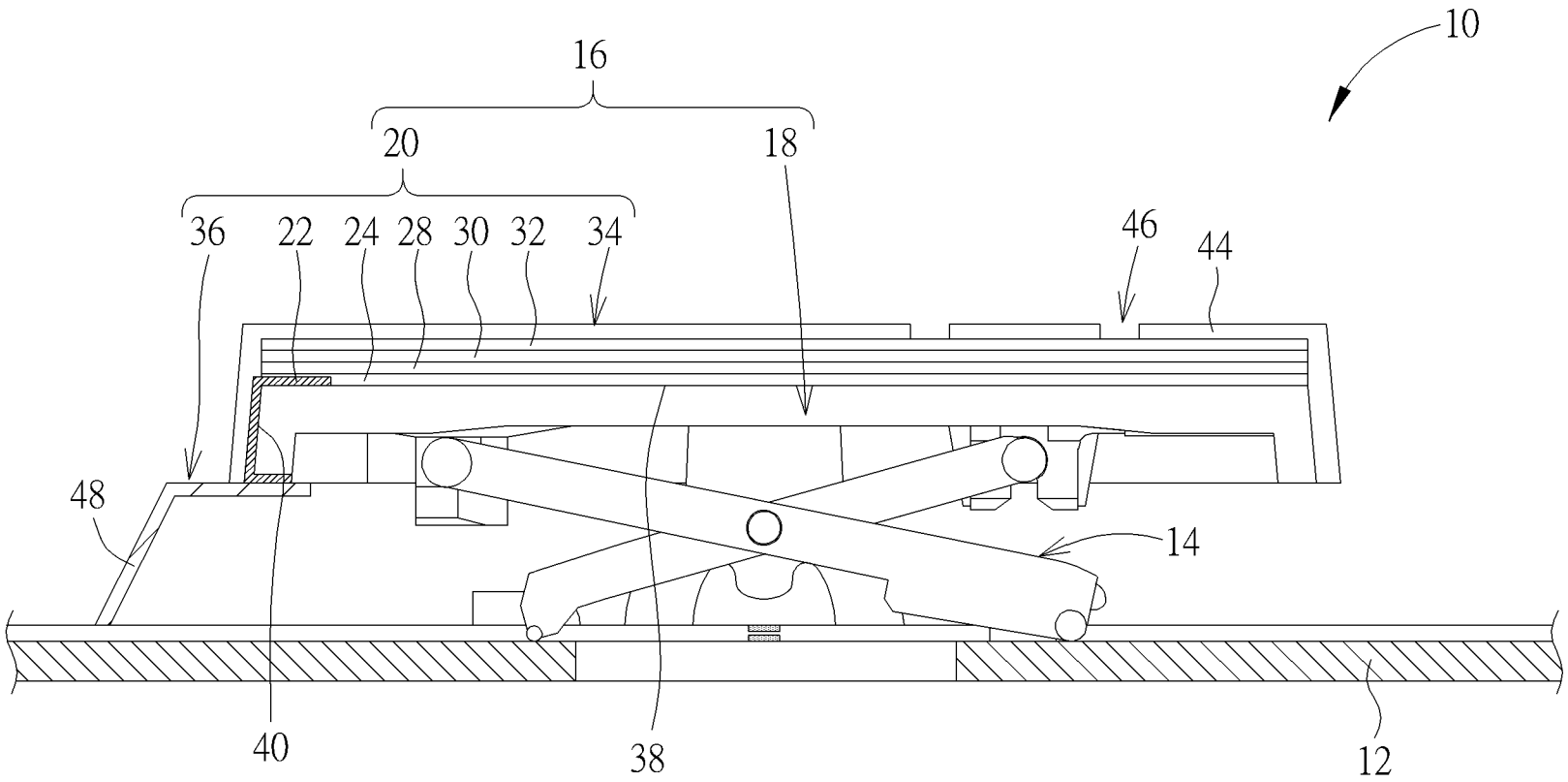
FIG. 2 is a cross-sectional diagram of a light-emitting keyswitch in FIG. 1 along a cross-sectional line A-A.

Please refer to FIG. 1 and FIG. 2. FIG. 1 is a diagram of a keyboard 1 according to an embodiment of the present invention. FIG. 2 is a cross-sectional diagram of a light-emitting keyswitch 10 in FIG. 1 along a cross-sectional line A-A. The keyboard 1 could be preferably applied to a portable electronic device with a foldable mechanism composed of an upper cover and a lower casing (e.g. a notebook or a foldable keyboard, but not limited thereto). The keyboard 1 includes a plurality of light-emitting keyswitches 10 and a board 12. The plurality of keyswitches is disposed on the board 12 for a user to perform input operations. The cap structural design provided by the present invention can be applied to at least one of the plurality of light-emitting keyswitches 10. In the following, more detailed description for only one light-emitting keyswitch 10 to which the aforesaid design is applied is provided. As for the related description for other light-emitting keyswitches 10 adopting the same design, it could be reasoned by analogy.

Figure 3:
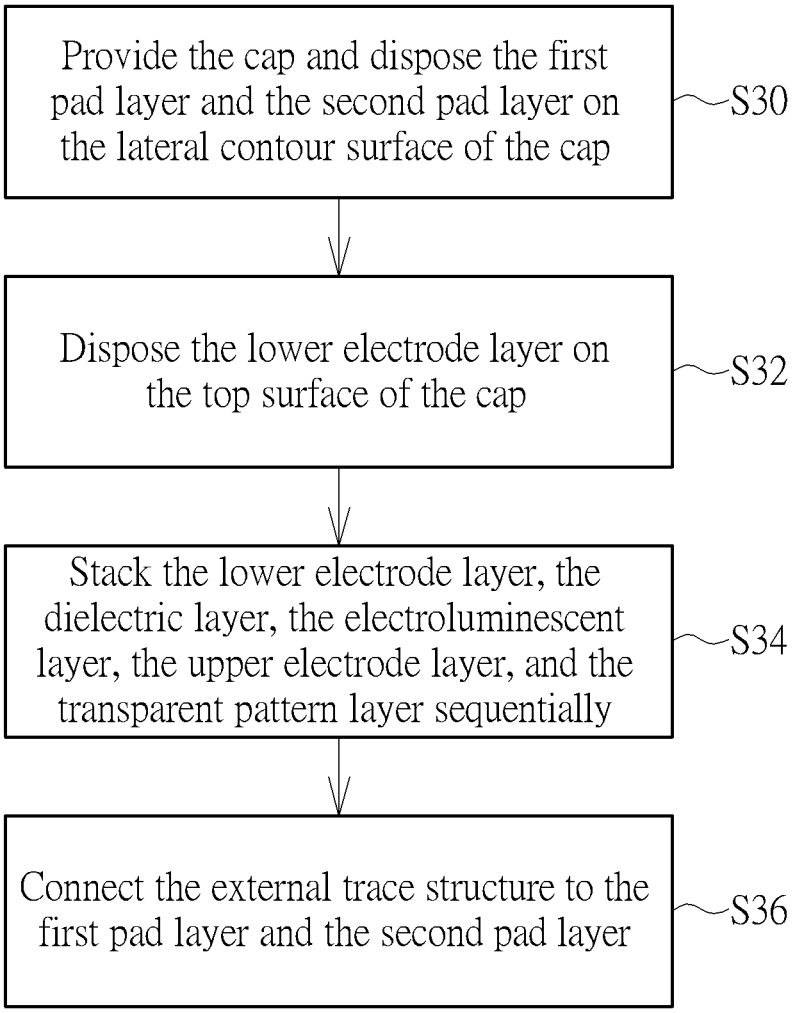
FIG. 3 is a flowchart of a cap structure manufacturing method according to an embodiment of the present invention.
Figure 4:
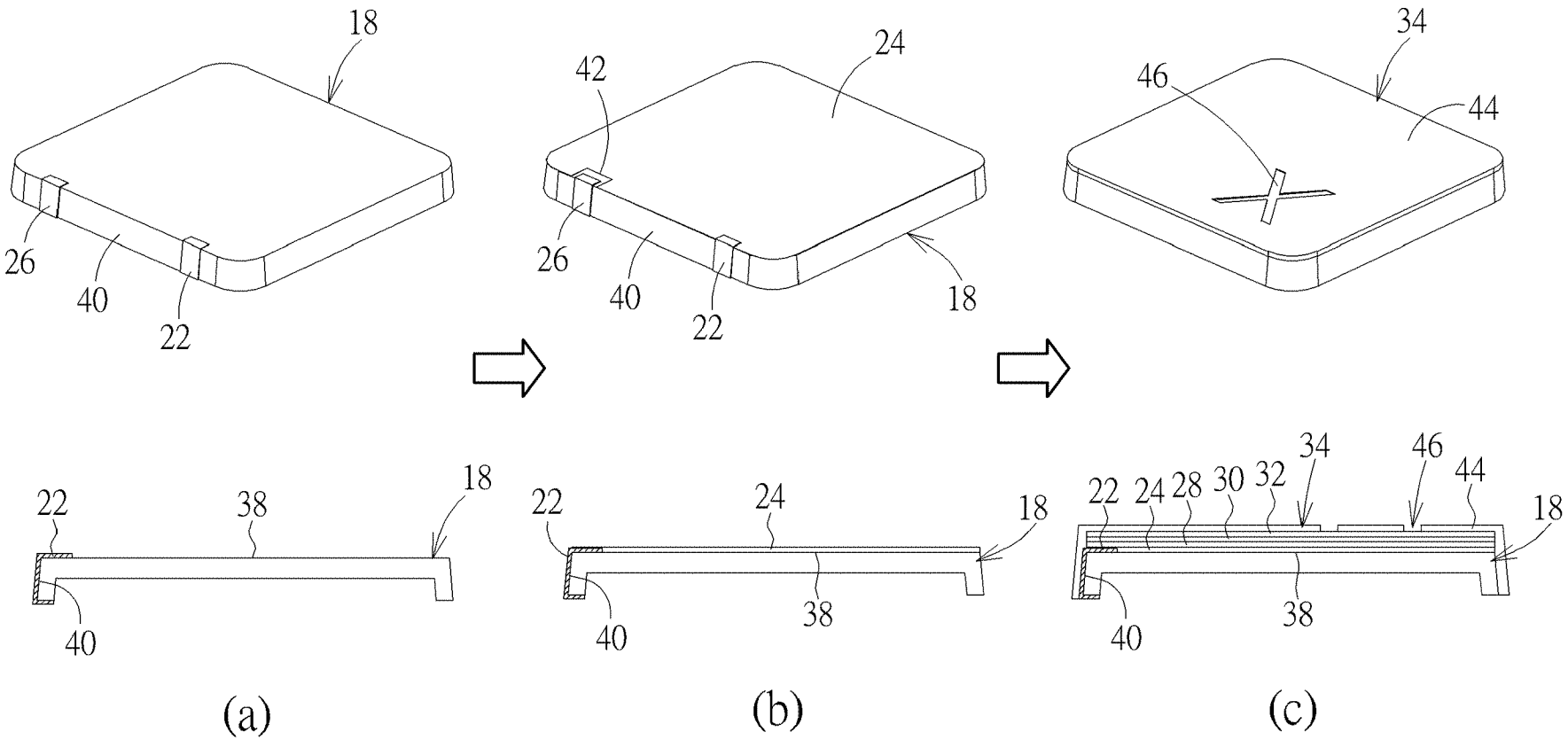
FIG. 4 is a process diagram of the cap structure manufacturing method in FIG. 3.

Please refer to FIG. 2, FIG. 3, and FIG. 4. FIG. 3 is a flowchart of a cap structure manufacturing method according to an embodiment of the present invention. FIG. 4 is a process diagram of the cap structure manufacturing method in FIG. 3. As shown in FIG. 2, the light-emitting keyswitch 10 includes a board 12, a lifting mechanism 14 and a cap structure 16. The lifting mechanism 14 is disposed on the board 12 and preferably adopts the scissor support mechanical design commonly applied to a keyswitch on a keyboard (but not limited thereto, meaning that the present invention could adopt other lifting mechanical design in another embodiment, such as a magnetic support mechanical design). Accordingly, the cap structure 16 can be assembled with the lifting mechanism 14 to be movable upward and downward relative to the board 12. To be more specific, the cap structure 16 includes a cap 18 and a light-emitting layer 20. The light-emitting layer 20 includes a first pad layer 22, at least one lower electrode layer 24 (one shown in FIG. 2, but not limited thereto, meaning that the present invention could adopt the design that plural lower electrode layers are formed on a top surface of a cap to generate the multi-section illumination effect), a second pad layer 26, a dielectric layer 28, an electroluminescent layer 30, an upper electrode layer 32, a transparent pattern layer 34, and an external trace structure 36. The forming process of the light-emitting layer 20 being formed on the cap 18 is as shown in FIG. 3 and FIG. 4.

In Step S30, the cap 18 has a top surface 38 and a lateral contour surface 40, and the first pad layer 22 and the second pad layer 26 are disposed on the lateral contour surface 40 and spaced apart from each other (as shown in FIG. 4(*a*)). Subsequently, in Step S32, the lower electrode layer 24 is disposed on the top surface 38 to be connected to the first pad layer 22 and has an opening 42, and the second pad layer 26 is disposed on the lateral contour surface 40 corresponding to the opening 42 as a conductive pad for subsequent connection to the upper electrode layer 32 (as shown in FIG. 4(*b*)). After forming of the first pad layer 22, the second pad layer 26 and the lower electrode layer 24 is completed, go to Step S34. In Step S34, the dielectric layer 28, the electroluminescent layer 30, the upper electrode layer 32, and the transparent pattern layer 34 are sequentially stacked on the lower electrode layer 24 (as shown in FIG. 4(*c*)), and the upper electrode layer 32 is connected to the second pad layer 26.

To be noted, forming of the first pad layer 22 and the second pad layer 26 could be preferably performed by a pad printing process, and forming of the lower electrode layer 24, the dielectric layer 28, and the electroluminescent layer 30 and the upper electrode layer 32 could be preferably performed by a screen printing process. In this embodiment, the transparent pattern layer 34 could include a non-transparent layer 44 and a hollow pattern 46. The non-transparent layer 44 could preferably adopt a painting process to be stacked on the upper electrode layer 32. The hollow pattern 46 could preferably adopt a laser engraving process to be formed in the non-transparent layer 44 for allowing light to pass therethrough to generate the pattern illumination effect. As for the related description for the aforesaid forming processes, it is commonly seen in the prior art and omitted herein.

Figure 5:
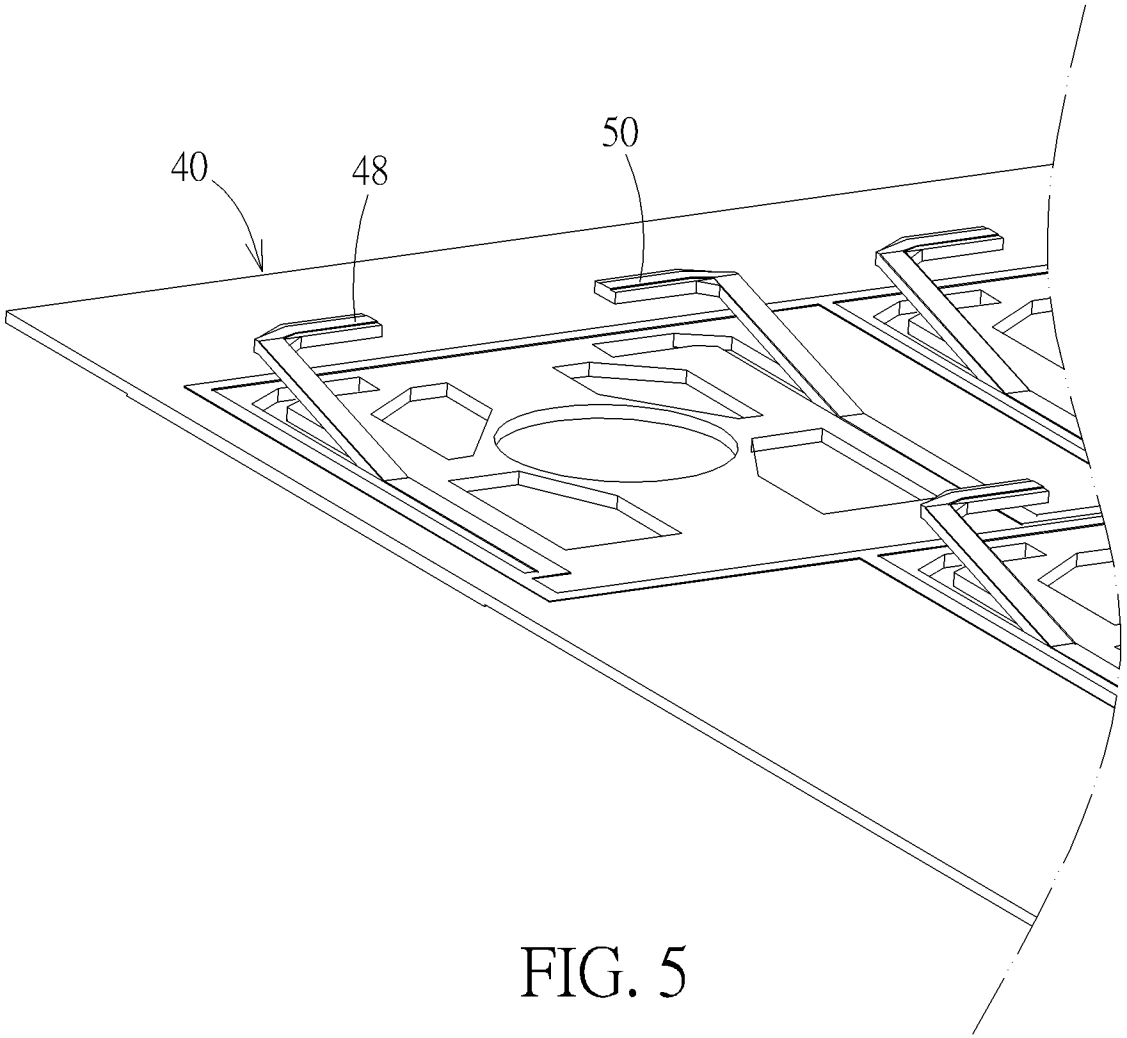
FIG. 5 is a partial enlarged diagram of an external trace structure in FIG. 2.

Finally, in Step S36, the external trace structure 36 is connected to the first pad layer 22 and the second pad layer 26. Accordingly, the external trace structure 36 can transmit power to the upper electrode layer 32 and the lower electrode layer 24 via the first pad layer 22 and the second pad layer 26, so as to drive the electroluminescent layer 30 to emit light to the transparent pattern layer 34 for generating the keyswitch illumination effect. In this embodiment, as shown in FIG. 2 and FIG. 5, the external trace structure 36 could be preferably a membrane circuit board and could have a first connection arm 48 and a second connection arm 50. As such, the first connection arm 48 can be connected to the first pad layer 22 and the second connection arm 50 can be connected to the second pad layer 26 for establishing power transmission between the membrane circuit board and the light-emitting layer 16. As for the related description for the electroluminescent principle and circuit configuration of the light-emitting layer 16, it is commonly seen in the prior art and omitted herein.

To be noted, the transparent pattern layer of the present invention could adopt the background color design. In brief, in another embodiment, the transparent pattern layer could include a non-transparent layer, a background-color transparent layer, and a hollow pattern. The background-color transparent layer is stacked on the upper electrode layer. The non-transparent layer is stacked on the background-color transparent layer. The hollow pattern is formed in the non-transparent layer to partially expose the background-color transparent layer. In such a manner, when the external trace structure transmits power to the upper electrode layer and the lower electrode layer to make the electroluminescent layer emit light to the transparent pattern layer, the color of the light provided from the transparent pattern layer depends on the color of the background-color transparent layer, so as to improve flexibility of the light-emitting keyswitch in the pattern illumination design. Furthermore, in another embodiment, the external trace structure of the present invention could adopt the flexible printed circuit design to be connected to the first pad layer and the second pad layer for establishing power transmission between the external trace structure and the light-emitting layer. As for which trace design is adopted, it depends on the practical application of the light-emitting keyswitch.

Via the aforesaid design that the light-emitting layer adopting the electroluminescent principle is directly formed on the cap, the light-emitting keyswitch of the present invention can provide the keyswitch illumination effect after the external trace structure transmits power to the upper electrode layer and the lower electrode layer to make the electroluminescent layer emit light to the transparent pattern layer. Since there is no need to additionally dispose any light emitting diode under the cap, the present invention can efficiently solve the prior art problem that the related optical structural design and circuit configuration of the light emitting diode may occupy much internal space of the light-emitting keyswitch, so as to be advantageous to the thinning design of the light-emitting keyswitch.

Figure 6:
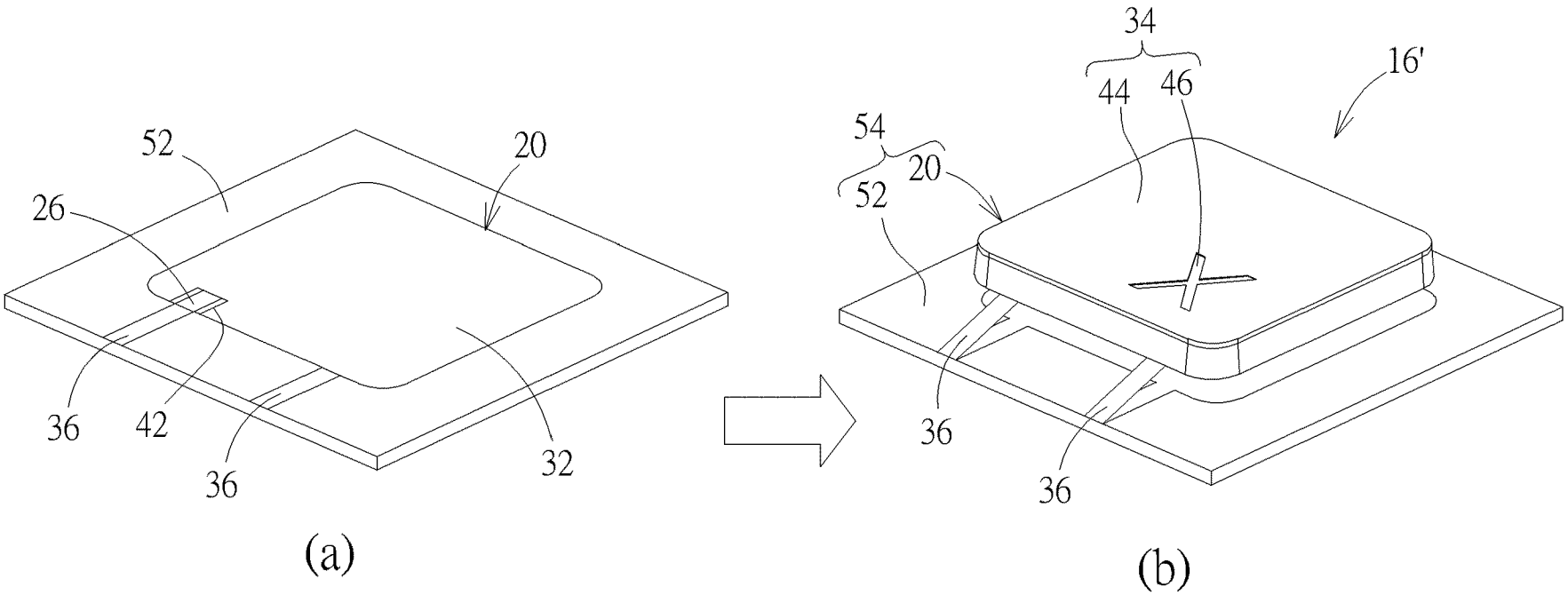
FIG. 6 is a process diagram of a cap structure manufacturing method according to another embodiment of the present invention.

It should be mentioned that the design in which the light-emitting layer is formed on the cap is not limited to the aforesaid embodiment, meaning that the present invention could adopt the film forming design. For example, please refer to FIG. 6, which is a process diagram of a cap structure manufacturing method according to another embodiment of the present invention. Components both mentioned in this embodiment and the aforesaid embodiments represent components with similar structures or functions, and the related description is omitted herein. In brief, as shown in FIG. 6, the cap structure 16' could include the cap 18 (not shown in FIG. 6), the light emitting layer 20, and a substrate film 52. In this embodiment, the first pad layer 22, the lower electrode layer 24, the second pad layer 26, the dielectric layer 28, the electroluminescent layer 30, the upper electrode layer 32, and the external trace structure 36 of the light-emitting layer 20 could be first formed on the substrate film 52 (as shown in FIG. 6(*a*)), and then the transparent pattern layer 34 could be stacked on the upper electrode layer 32 to form the light-emitting layer 20 on the substrate film 52. Finally, the substrate film 52 in FIG. 6(*a*) could be shaped by the cap 18, and then the substrate film 52 could be cut to make the light-emitting layer 20 and the substrate film 52 cooperatively form a cap covering layer 54. After the cap covering layer 54 is attached to the cap 18 to make the first pad layer 22 and the second pad layer 26 attached to the lateral contour surface 40 of the cap 18 and make the lower electrode layer 24 attached to the top surface 38 of the cap 18, the forming process of the cap structure 16' can be completed accordingly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting keyswitch comprising:
- a board;
- a lifting mechanism disposed on the board; and
- a cap structure assembled with the lifting mechanism to be movable upward and downward relative to the board, the cap structure comprising:
  - a cap having a top surface and a lateral contour surface; and
  - a light-emitting layer comprising:
    - a first pad layer disposed on the lateral contour surface;
    - at least one lower electrode layer disposed on the top surface to be connected to the first pad layer, the at least one lower electrode layer having an opening;
    - a second pad layer disposed on the lateral contour surface corresponding to the opening and spaced apart from the at least one lower electrode layer;
    - a dielectric layer stacked on the lower electrode layer;
    - an electroluminescent layer stacked on the dielectric layer;
    - an upper electrode layer stacked on the electroluminescent layer and connected to the second pad layer;
    - a transparent pattern layer stacked on the upper electrode layer; and
    - an external trace structure connected to the first pad layer and the second pad layer for transmitting a power to the upper electrode layer and the lower electrode layer via the first pad layer and the second pad layer, so as to drive the electroluminescent layer to emit light to the transparent pattern layer.

2. The light-emitting keyswitch of claim 1, wherein the transparent pattern layer comprises a non-transparent layer and a hollow pattern, the non-transparent layer is stacked on the upper electrode layer, and the hollow pattern is formed in the non-transparent layer by a laser engraving process.

3. The light-emitting keyswitch of claim 1, wherein the transparent pattern layer comprises a non-transparent layer, a background-color transparent layer, and a hollow pattern, the background-color transparent layer is stacked on the upper electrode layer, the non-transparent layer is stacked on the background-color transparent layer, and the hollow pattern is formed in the non-transparent layer by a laser engraving process to partially expose the background-color transparent layer.

4. The light-emitting keyswitch of claim 1, wherein the external trace structure is a membrane circuit board, a first connection arm and a second connection arm are formed on the membrane circuit board, and the first connection arm is connected to the first pad layer and the second connection arm is connected to the second pad layer to establish power transmission between the membrane circuit board and the light-emitting layer.

5. The light-emitting keyswitch of claim 1, wherein the external trace structure is a flexible printed circuit board, and the flexible printed circuit board is connected to the first pad layer and the second pad layer to establish power transmission between the flexible printed circuit board and the light-emitting layer.

6. The light-emitting keyswitch of claim 1, wherein the cap structure further comprises a substrate film, the light-emitting layer is formed on the substrate film for forming a cap covering layer, and the cap covering layer is attached to the cap to make the first pad layer and the second pad layer attached to the lateral contour surface and make the at least one lower electrode layer attached to the top surface.

7. A cap structure assembled with a lifting mechanism to be movable upward and downward relative to a board, the cap structure comprising:
- a cap having a top surface and a lateral contour surface; and
- a light-emitting layer comprising:
  - a first pad layer disposed on the lateral contour surface;
  - at least one lower electrode layer disposed on the top surface to be connected to the first pad layer, the at least one lower electrode layer having an opening;
  - a second pad layer disposed on the lateral contour surface corresponding to the opening and spaced apart from the at least one lower electrode layer;
  - a dielectric layer stacked on the lower electrode layer;
  - an electroluminescent layer stacked on the dielectric layer;
  - an upper electrode layer stacked on the electroluminescent layer and connected to the second pad layer;
  - a transparent pattern layer stacked on the upper electrode layer; and
  - an external trace structure connected to the first pad layer and the second pad layer for transmitting a power to the upper electrode layer and the lower electrode layer via the first pad layer and the second pad layer, so as to drive the electroluminescent layer to emit light to the transparent pattern layer.

8. The cap structure of claim 7, wherein the transparent pattern layer comprises a non-transparent layer and a hollow pattern, the non-transparent layer is stacked on the upper electrode layer, and the hollow pattern is formed in the non-transparent layer by a laser engraving process.

9. The cap structure of claim 7, wherein the transparent pattern layer comprises a non-transparent layer, a background-color transparent layer, and a hollow pattern, the background-color transparent layer is stacked on the upper electrode layer, the non-transparent layer is stacked on the background-color transparent layer, and the hollow pattern is formed in the non-transparent layer by a laser engraving process to partially expose the background-color transparent layer.

10. The cap structure of claim 7, wherein the external trace structure is a membrane circuit board, a first connection arm and a second connection arm are formed on the membrane circuit board, and the first connection arm is connected to the first pad layer and the second connection arm is connected to the second pad layer to establish power transmission between the membrane circuit board and the light-emitting layer.

11. The cap structure of claim 7, wherein the external trace structure is a flexible printed circuit board, and the flexible printed circuit board is connected to the first pad layer and the second pad layer to establish power transmission between the flexible printed circuit board and the light-emitting layer.

12. The cap structure of claim 7, wherein the cap structure further comprises a substrate film, the light-emitting layer is formed on the substrate film for forming a cap covering layer, and the cap covering layer is attached to the cap to make the first pad layer and the second pad layer attached to the lateral contour surface and make the at least one lower electrode layer attached to the top surface.

13. A cap structure manufacturing method comprising:

providing a cap, the cap having a top surface and a lateral contour surface;

disposing a first pad layer on the lateral contour surface;

disposing at least one lower electrode layer on the top surface, the at least one lower electrode layer being connected to the first pad layer and having an opening;

disposing a second pad layer on the lateral contour surface corresponding to the opening, the second pad layer being spaced apart from the at least one lower electrode layer;

stacking the at least one lower electrode layer, a dielectric layer, an electroluminescent layer, an upper electrode layer and a transparent pattern layer, the upper electrode layer being connected to the second pad layer; and connecting an external trace structure to the first pad layer and the second pad layer, the external trace structure transmitting a power to the upper electrode layer and the lower electrode layer via the first pad layer and the second pad layer for driving the electroluminescent layer to emit light to the transparent pattern layer.

14. The cap structure manufacturing method of claim 13, wherein the transparent pattern layer comprises a non-transparent layer and a hollow pattern, the non-transparent layer is stacked on the upper electrode layer, and the hollow pattern is formed in the non-transparent layer by a laser engraving process.

15. The cap structure manufacturing method of claim 13, wherein the transparent pattern layer comprises a non-transparent layer, a background-color transparent layer, and a hollow pattern, the background-color transparent layer is stacked on the upper electrode layer, the non-transparent layer is stacked on the background-color transparent layer, and the hollow pattern is formed in the non-transparent layer by a laser engraving process to partially expose the background-color transparent layer.

16. The cap structure manufacturing method of claim 13, wherein the external trace structure is a membrane circuit board, a first connection arm and a second connection arm are formed on the membrane circuit board, and the first connection arm is connected to the first pad layer and the second connection arm is connected to the second pad layer to establish power transmission between the membrane circuit board and the light-emitting layer.

17. The cap structure manufacturing method of claim 13, wherein the external trace structure is a flexible printed circuit board, and the flexible printed circuit board is connected to the first pad layer and the second pad layer to establish power transmission between the flexible printed circuit board and the light-emitting layer.

18. The cap structure manufacturing method of claim 13 further comprising:

forming the first pad layer, the second pad layer, the lower electrode layer, the dielectric layer, the electroluminescent layer, the upper electrode layer, and the transparent pattern layer on a substrate film for forming a cap covering layer; and attaching the cap covering layer to the cap to make the first pad layer and the second pad layer attached to the lateral contour surface and make the at least one lower electrode layer attached to the top surface.

* * * * *